US009560899B2

(12) United States Patent
Stepper et al.

(10) Patent No.: US 9,560,899 B2
(45) Date of Patent: Feb. 7, 2017

(54) ADJUSTABLE BRACELET

(71) Applicants: Mark Stepper, Needham, MA (US); David Stepper, Cambridge, MA (US)

(72) Inventors: Mark Stepper, Needham, MA (US); David Stepper, Cambridge, MA (US)

(73) Assignee: Stepper Bros., LLC, Brighton, MA (US)

( * ) Notice: Subject to any disclaimer, the term of this patent is extended or adjusted under 35 U.S.C. 154(b) by 0 days.

(21) Appl. No.: 14/485,185

(22) Filed: Sep. 12, 2014

(65) Prior Publication Data

US 2015/0075218 A1 Mar. 19, 2015

Related U.S. Application Data

(60) Provisional application No. 61/877,817, filed on Sep. 13, 2013.

(51) Int. Cl.

| | |
|---|---|
| ***A44C 5/00*** | (2006.01) |
| ***A44C 5/20*** | (2006.01) |
| ***A44C 5/12*** | (2006.01) |
| *A44C 9/00* | (2006.01) |

(52) U.S. Cl.

CPC ..... *A44C 5/0061* (2013.01); *A44C 5/12* (2013.01); *A44C 5/2019* (2013.01); *A44C 9/0038* (2013.01)

(58) Field of Classification Search

CPC ..... A44C 5/00; A44C 5/0053; A44C 5/0061; A44C 5/0069; A44C 5/0076; A44C 5/12; A44C 5/2016; A44C 9/0038

USPC ..... 63/3, 3.1, 3.2, 4, 15.45; D11/4; 224/179; 132/273

See application file for complete search history.

(56) References Cited

U.S. PATENT DOCUMENTS

| | | | | | |
|---|---|---|---|---|---|
| 554,417 | A | * | 2/1896 | Forsheim | 59/89 |
| 1,042,918 | A | * | 10/1912 | Houck | 70/457 |
| D55,788 | S | | 7/1920 | Griffin | |
| 2,015,616 | A | * | 9/1935 | Clark | 24/600.6 |
| 2,052,381 | A | * | 8/1936 | Chernow | 63/4 |
| 4,033,143 | A | * | 7/1977 | Michael | 63/15 |
| D247,482 | S | * | 3/1978 | Schupp | D11/4 |
| 4,862,435 | A | * | 8/1989 | Reichel et al. | 368/282 |
| D372,680 | S | * | 8/1996 | Salva et al. | D11/4 |
| 5,605,262 | A | * | 2/1997 | Bond | G04B 37/1486 224/164 |
| D383,698 | S | | 9/1997 | Fletcher | |
| D383,702 | S | | 9/1997 | MacDonald | |
| 5,741,035 | A | * | 4/1998 | Glass | 294/25 |
| 5,758,516 | A | | 6/1998 | Uematsu | |
| 6,155,409 | A | | 12/2000 | Hettinger | |
| 6,470,708 | B1 | * | 10/2002 | Green | 63/3.2 |
| D472,177 | S | * | 3/2003 | McCullough-McPherson | D11/4 |
| D474,423 | S | * | 5/2003 | James | D11/231 |

(Continued)

OTHER PUBLICATIONS

Signed Trifari Vintage Bracelet, No Date, www.etsy.com, pp. 1-5.*

(Continued)

*Primary Examiner* — Abigail Morrell

(74) *Attorney, Agent, or Firm* — Wolf, Greenfield & Sacks, P.C.

(57) ABSTRACT

A method and apparatus for adjusting the size of a bracelet are disclosed. In one embodiment, the bracelet includes a first end with a plurality of size adjustment openings and a second end having a hook. The hook is configured to latch on to one of the plurality of size adjustment openings to adjust the diameter of the bracelet.

11 Claims, 8 Drawing Sheets

(56) References Cited

U.S. PATENT DOCUMENTS

| | | | | |
|---|---|---|---|---|
| D484,783 | S | 1/2004 | Woodhall | |
| 7,210,313 | B1 * | 5/2007 | Kay | 63/3.1 |
| D590,289 | S | 4/2009 | Karpman | |
| D591,634 | S * | 5/2009 | Gorman | D11/4 |
| D597,881 | S | 8/2009 | Hou | |
| D616,325 | S | 5/2010 | Shaforost | |
| D684,083 | S | 6/2013 | Bulgari | |
| D694,662 | S | 12/2013 | Buckley | |
| D701,645 | S | 3/2014 | Noel | |
| D704,087 | S | 5/2014 | DiPietro | |
| D705,692 | S | 5/2014 | Mello | |
| D707,582 | S | 6/2014 | DiPietro | |
| D712,298 | S | 9/2014 | Taylor-Cattapan | |
| D712,299 | S | 9/2014 | DiPietro | |
| D727,771 | S | 4/2015 | Lerman | |

OTHER PUBLICATIONS

Vintage trifari hook bracelet!, No Date, www.poshmark.com, pp. 1-3.*

The Beauty of Trifari jewelry, No Date, www.viola.bz, pp. 2-44.*

U.S. Appl. No. 29/485,094, filed Mar. 14, 2014, Stepper et al.

[No Author Listed Photograph of bracelet. Publicly available. 1 page.

[No Author Listed] Women's Bracelets: Shop Bracelets & Bangles for Women. Express. http://www.express.com/clothing/Categories/Bracelets/cat/cat570009?pageNumber=1&viewAll=true. Last accessed via the Wayback Machine on Feb. 27, 2015, noting archive date of Aug. 3, 2013. 6 pages.

* cited by examiner

ADJUSTABLE BRACELET

CROSS-REFERENCE TO RELATED APPLICATIONS

This application claims the benefit under 35 U.S.C. §119 (e) to U.S. Provisional Application Ser. No. 61/877,817, entitled "ADJUSTABLE BRACELET" filed on Sep. 13, 2013, which is herein incorporated by reference in its entirety.

FIELD

The invention relates generally to jewelry items and more specifically to bracelets.

BACKGROUND

Various types of bracelets are known, which a wearer may wear for decorative or support purposes, for identification, or for symbolic reasons.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Applicants have recognized that by providing a bracelet with a clasp portion having openings to adjust the size of the bracelet to accommodate various wrist sizes advantages may be realized.

Figure 1:
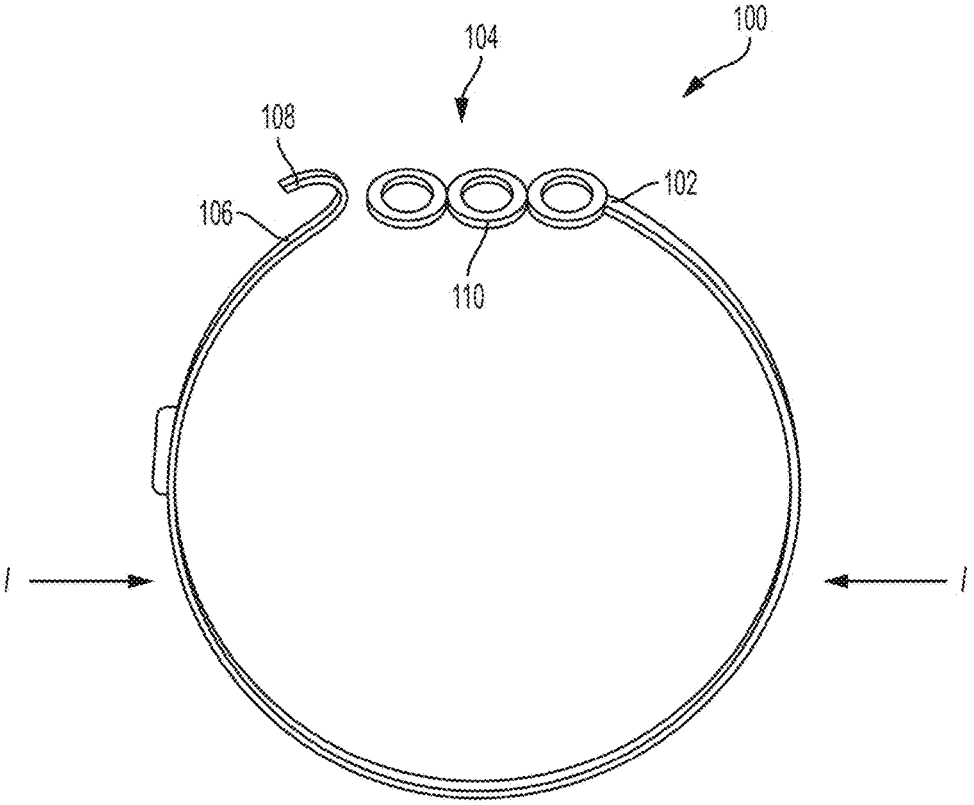
FIG. 1 is a side view of an adjustable bracelet according to one embodiment.

According to one embodiment, as shown in FIG. 1, the bracelet has a first end 102 with a clasp portion 104 and a second end 106 with a hook 108. The clasp portion 104 may include size adjustment openings 110 into which the hook 108 can be inserted for a latching engagement. As shown in FIG. 1, the bracelet 100 may have a circular shape, although the bracelet 100 may have other suitable shape for fitting around a wearer's wrist as the disclosure is not limited in this regard.

Although the bracelet is shown as having a hook 108 in this embodiment, it should be appreciated that other engagement elements may be used to secure the bracelet around a user's wrist. For example, in some embodiment, the second end 106 of the bracelet may include a stopper, latch or other decorative element that may be inserted into or otherwise engage with the size adjustment openings 110. In one embodiment, for example, the second end 106 of the bracelet 100 may include an alligator clasp which may be engaged with one of the size adjustment openings.

Figure 2A:
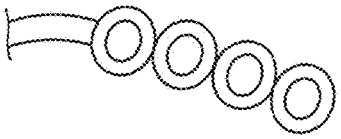
FIGS. 2A-2J are schematic front views of a clasp portion of an adjustable bracelet according to several embodiments.
Figure 2B:
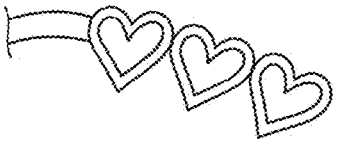

In one embodiment, as show in FIG. 1, the clasp portion 104 includes three size adjustment openings 110. Although three openings are shown in this figure, a skilled artisan should appreciate that more or fewer size adjustment openings 110 may be used as this aspect of the disclosure is not limited in this regard. For example, in some embodiments, the clasp portion 104 includes two size adjustment openings 110, and, in other embodiments, as illustrated in FIG. 2A, the clasp portion 104 includes four size adjustment openings 110. The bracelet 100 also may include more than four size adjustment openings 110 in some embodiments.

Figure 3:
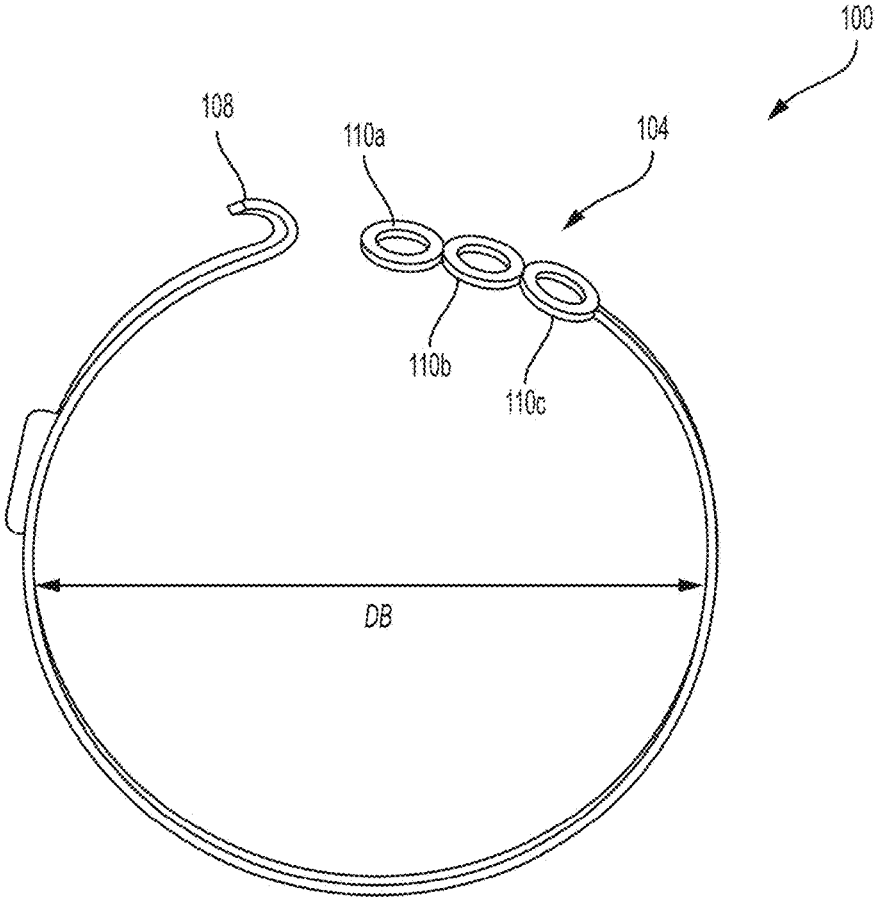
FIG. 3 is a side view of an adjustable bracelet according to one embodiment.

In some embodiments, the size adjustment openings 110 correspond to different sizes to which a wearer may adjust the bracelet 100. For example, as shown in FIG. 3, the clasp portion 104 may include three size openings 110*a*, 110*b*, 110*c* that correspond to large, medium, and small bracelet sizes. As shown in this figure, the large bracelet size corresponds to the opening 110*a* that is closest to the hook 108, and the small bracelet size corresponds to the opening 110*c* that is farthest from the hook 108. Additional size adjustment openings 110 may be included in other embodiments to allow for extra-small and extra-large bracelet sizes. In such embodiments, the size adjustment opening for the extra-large bracelet size may be located adjacent to the large bracelet size opening 110*a*, closest to the hook 108, and the size adjustment opening for the extra-small bracelet size may be located adjacent to the small bracelet size opening 110*c*, farthest from the hook 108.

In some embodiments, when the wearer latches the hook onto the adjustment opening 110 corresponding with his or her bracelet size, the diameter DB of the bracelet changes to accommodate to his or her wrist size. In some embodiments, the bracelet has a diameter DB of between about 65 mm and 69 mm when the bracelet is in the open, unclasped position. The diameter DB of the opened bracelet also may be about 67 mm±1 mm. A person having skill in the art should appreciate that the bracelet may have other suitable diameters as this aspect of the disclosure is not limited in this regard.

In embodiments in which the wearer chooses to adjust the bracelet to the large size and inserts the hook 108 into the corresponding opening 110*a*, the diameter of the bracelet DB may be adjusted to between about 62 mm and 65 mm or adjusted to about 63.5 mm±1 mm. In embodiments in which the wearer desires a medium-sized bracelet and inserts the hook 108 into the respective opening 110*b*, the diameter of the bracelet DB may be adjusted to between about 58 mm and 62 mm or adjusted to about 60 mm±1 mm. In embodiments in which the wearer desires a small-sized bracelet, and inserts the hook 108 into the corresponding opening 110*c*, the diameter of the bracelet DB may be adjusted to between about 55 mm and 59 mm or adjusted to about 57 mm±1 mm. Although embodiments described above include a bracelet 100 with a diameter that can adjust between about 55 mm and 65 mm, depending upon the bracelet size that is chosen, it should be appreciated that other suitable diameters can be used. A person of ordinary skill in the art should further appreciate that the diameters described for each of the small, medium, and large sized bracelets may vary from the diameters described above as the disclosure is not limited in this regard.

Figure 2C:
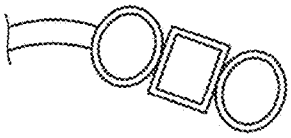
Figure 2D:
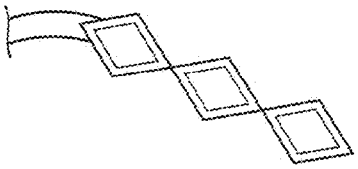
Figure 2E:
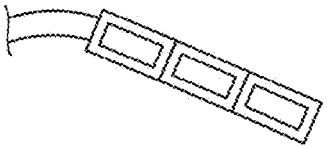
Figure 2F:
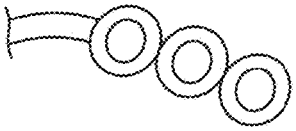
Figure 2G:
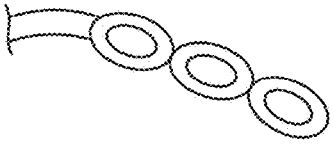
Figure 2H:
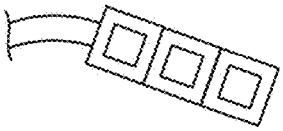
Figure 2I:
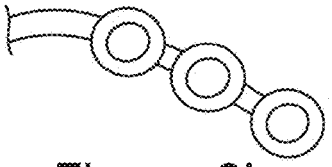
Figure 2J:
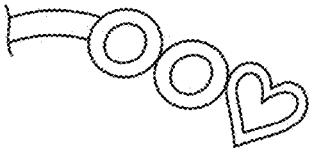

In some embodiments, as seen in FIG. 1, the size adjustment openings 110 are circular in shape. As should be appreciated, the size adjustment openings 110 may have any shape suitable for engagement with the hook 108. For example, as seen in FIGS. 2A-2J, the size adjustment openings 110 may have an oval, diamond, square, heart, and/or rectangular shape. The size adjustment openings 110 also may be shaped like a star, shell, flower, sun, cloud, or triangle or any other novelty type shape where the opening is large enough to fit the hook 108. The size adjustment openings 110 in the clasp portion 104 may have the same shape, as seen in 2A-2B, and 2D-2I. The clasp portion 104 also may include adjustment openings 110 having different shapes, as seen in FIGS. 2C and 2J, for example, and having different combinations of those shapes. For example, while the heart-shaped size adjustment opening of FIG. 2J is shown as being adjacent to the two circular size adjustment openings (e.g., circle, circle, heart), in another embodiment, the heart-shaped size adjustment opening may be positioned in between the two circular size adjustment openings (e.g., circle, heart, circle).

In some embodiments, the size adjustment openings 110 may be positioned adjacent to each other at the first end 102 of the bracelet 100. For purposes herein, an adjacent size adjustment opening may include a size adjustment opening that is positioned directly adjacent to another size adjustment opening. An adjacent size adjustment opening also may include a size adjustment opening that is distanced from another size adjustment opening, as shown in FIG. 2I, for example. In some embodiments, the size adjustment openings 110 may be separated via a bar, ball, square or via other elements suitable for distancing the size adjustment openings 110 as this aspect of the disclosure is not limited in this regard. In some embodiments, the size adjustment openings 110 are separated by the soldering, epoxy or other adhesive that is used to connect the openings 110 to each other.

Figure 4:
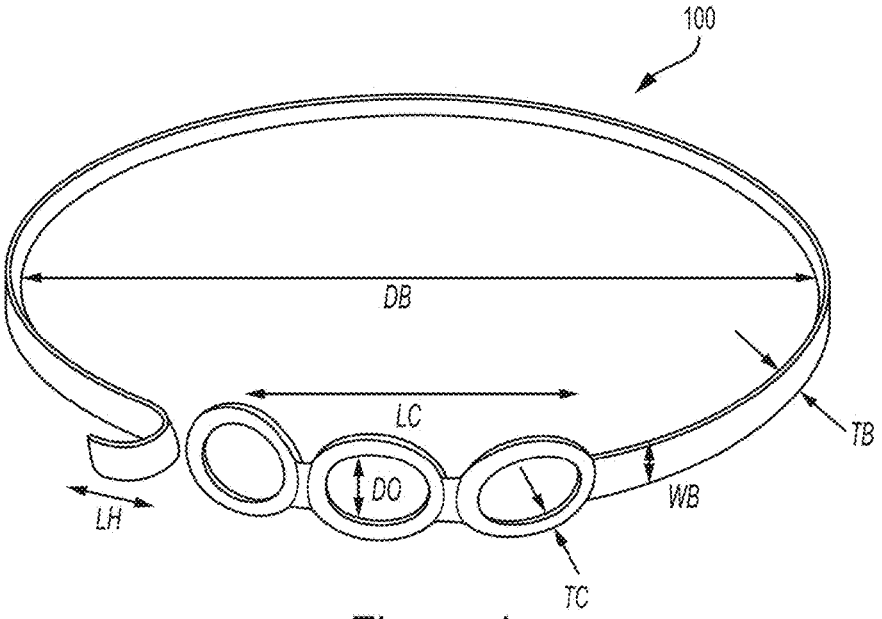
FIG. 4 is an adjustable bracelet according to one embodiment.

As shown in FIG. 4, an embodiment in which each of the openings 110 are circular, and the same size, the openings 110 may have a diameter DO of between about 6 mm and 10 mm or a diameter DO of about 8 mm±1 mm, although other suitable diameters DO may be used. The clasp portion 104 may have a length LC of between about 20 mm and 24 mm. The clasp portion also may have a length LC of about 22 mm±1 mm. In some embodiments, the clasp portion 104 may be straight, however in other embodiments the clasp portion 104 is curved or slightly curved. In one embodiment, the curvature of the clasp portion 104 may correspond to a curvature of a wearer's wrist. In some embodiments, the clasp portion 104 has a gauge or thickness TC of between about 1 mm and 2 mm, although other suitable thicknesses may be used as this aspect of the disclosure is not limited in this regard. A person having ordinary skill in the art also should appreciate that the clasp portion 104 may be bigger or smaller than that the clasp portion 104 described. For example, the clasp portion 104 may have a length LC that is longer or smaller or a gauge or thickness TC that is thicker or thinner than those described. Additionally, although the openings 100 are described as having the same size in these embodiments, in other embodiments, the size of the openings may vary from opening 110 to opening 110 in the clasp portion 104. For example, the clasp portion 104 may have openings 110 with different diameters and thicknesses or may have at least two openings 110 with the same diameter and thickness.

In some embodiments, the hook 108 may have a curved shape. In one embodiment, the hook 108 may extend outwardly and curve in a direction away from the size adjustment openings 110 in the clasp portion 104. In another embodiment, the hook 108 may extend inwardly and curve in a direction away from the size adjustment openings 110. For purposes herein, inwardly refers to a direction toward a center of the bracelet and outwardly refers to a direction away from the center of the bracelet. For embodiments in which the hook extends outwardly, the hook may be inserted into the back of the opening 110, from the interior side of the clasp portion 104, whereas for embodiments in which the hook extends inwardly, the hook may be inserted into the front of the opening 110. In some embodiments, an outwardly extending hook may be inserted through the front of the opening 110 and may latch onto the adjacent opening 110.

As shown in FIG. 4, in some embodiments, the hook 108 may have a length LH of between about 4 mm and 7 mm. The hook 108 also may have a length LH of between about 5 mm and 6 mm. Although the hook shown in this figure is curved, a skilled artisan should appreciate that other hook shapes suitable for latching may be used in the bracelet 100 as this aspect of the disclosure is not limited. For example, in some embodiments, the hook 108 may have a square end. The hook 108 also may have a diamond end or an oval end.

Figure 5:
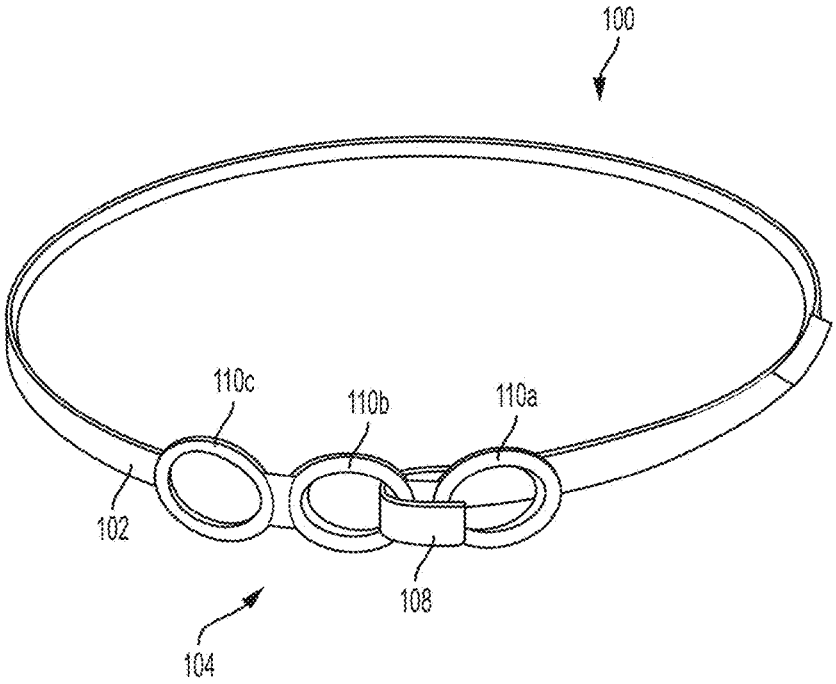
FIG. 5 is an adjustable bracelet according to one embodiment.

In some embodiments, to wear the bracelet, the user slides the opened, unlatched bracelet 100 (e.g., as shown in FIG. 1) onto his or her wrist. The wearer then squeezes at least two points along the circumference of the bracelet 100 (e.g., as shown by the arrows I in FIG. 1) which, in turn, allows the user to move the hook behind the clasp portion 104, in this example, and insert the hook 108 into the size adjustment opening 110 that corresponds with the desired bracelet size. When the user releases the bracelet 100, the hook 108 latches onto the selected size adjustment opening 110. For example, as shown in FIG. 5, a bracelet 100 which has three size adjustment openings 110*a*, 110*b*, 110*c* that correspond to large, medium, and small bracelet sizes, the wearer has inserted the hook 108 into the medium adjustment size opening 110*b*. The bracelet 100 in this figure is shown in closed position, after the wearer has released the bracelet and the hook 108 has latched onto the medium adjustment size opening 110*b*.

Figure 6:
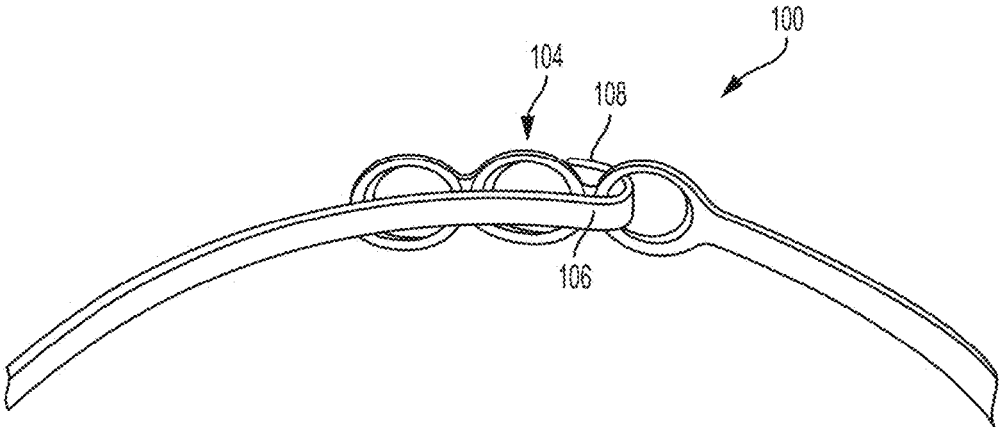
FIG. 6 is an enlarged view of an adjustable bracelet according to one embodiment.

As shown in FIG. 6, an embodiment in which the hook 108 extends outwardly, after the hook 108 has been latched onto the desired opening 110, the second end of the bracelet is positioned behind the clasp portion 104. In embodiments where the hook extends inwardly, the second 106 end may be positioned in front of the clasp portion 104 in the closed position. In some embodiments, the second end of the bracelet is positioned flush with and/or flush against the clasp portion 104.

In some embodiments, when the wearer desires to remove the bracelet, he or she squeezes at least two points along the circumference of the bracelet 100 (e.g., as shown by the arrows I in FIG. 1). This allows the hook 108 to unlatch from the selected opening 110 and allows the wearer to remove the hook 108 from the opening 110. Once the hook 108 is removed from the opening 110, the wearer may release the bracelet 100, allowing the bracelet to return to the opened position, and slide the bracelet 100 off of his or her wrist.

In some embodiments, to allow adjustment of the size of the bracelet 100 as described above, the bracelet 100 includes a material and gauge that is sufficiently strong and rigid to maintain the original shape of the bracelet yet flexible to allow the wearer to squeeze the sides and move the hook 108 into one of the size adjustment openings 110. In some embodiments, the bracelet 100 includes a brass material. A skilled artisan should appreciate that other suitable materials may be used as this aspect of the disclosure is not limited in this regard. In some embodiments, the bracelet 100 may be finished in a gold, silver or colored plating or paint. The plating and finishing color also may include a copper, gunmetal, white, pink, purple, green, black, or other suitable color. The exterior surface of the bracelet may have a smooth finish, however, the exterior surface of the bracelet 100 also may be decorated with engravings, embossed detail, patterns, soldered or glued on decorative elements and/or scalloped edges.

In some embodiments, to allow for secure engagement between the hook 108 and openings 110, the clasp portion 104 includes a material heavy enough to maintain the shape of the size adjustment openings 110 and to maintain the latching engagement with the hook 108. In some embodiments the clasp portion 104 includes a brass material, although other suitable materials may be used as this aspect of the disclosure is not limited. For example, the clasp portion 104 may be made of sterling silver, gold, pewter, aluminum or other suitable metals, or of rubber, plastic, fabric, braided thread, string, rope or leather. As with the bracelet 100, in embodiments in which the clasp portion 104 is cast in brass, the clasp portion 104 also may be finished with a gold, silver or other colored plating. In some embodiments, the clasp portion 104 is first cast and then is affixed to the first end 102 of the bracelet. In some embodiments, the clasp portion 104 is affixed to the bracelet using a soldering method, although the clasp portion 104 also may be affixed to the bracelet using an epoxy or other adhesive. In other embodiments, the clasp portion 104 is integrally formed with the rest of the bracelet. Depending on the material, the clasp portion 104 may be a continuous appendage on the bracelet. In some embodiments, the clasp portion 104 is formed by punching or drilling the size adjustment openings 110. The bracelet also may be cast or molded with the openings already incorporated, making the bracelet one integral piece instead of separate portions.

In some embodiments, the clasp portion 104 is formed of a different material than the material used to form the rest of the bracelet 100. In other embodiments, the clasp portion 104 and the hook 108 are formed of the same material, but are both formed of a different material than the rest of the bracelet. The clasp portion 104, hook 108, and the rest of the bracelet 100 also may be formed of the same material.

In some embodiments, the bracelet 100 is a bangle that is flat with slightly rounded edges. As shown in FIG. 4, the bracelet 100 may have a width WB of between about 2 mm and about 5 mm. In some embodiments the bracelet has a width WB about 3 mm±1 mm. In some embodiments, the bracelet 100 has a thickness TB of between about 0.5 mm and 2 mm. In some embodiments, the bracelet has a thickness TB of about 1 mm. A skilled artisan should appreciate that the width WB and thickness TB of the bracelet 100 may be varied in other embodiments as this aspect of the disclosure is not limited in this regard.

Although the embodiments shown and described have adjustment openings 110 located only in the clasp portion 104, the openings 110 may extend around other portions of the circumference of the bracelet 100. In some embodiments, the openings 110 extend around the entire circumference of the bracelet, from the first end 102 to the second end 104, or, in other embodiments, from the first end 102 to the hook 108.

Figure 7:
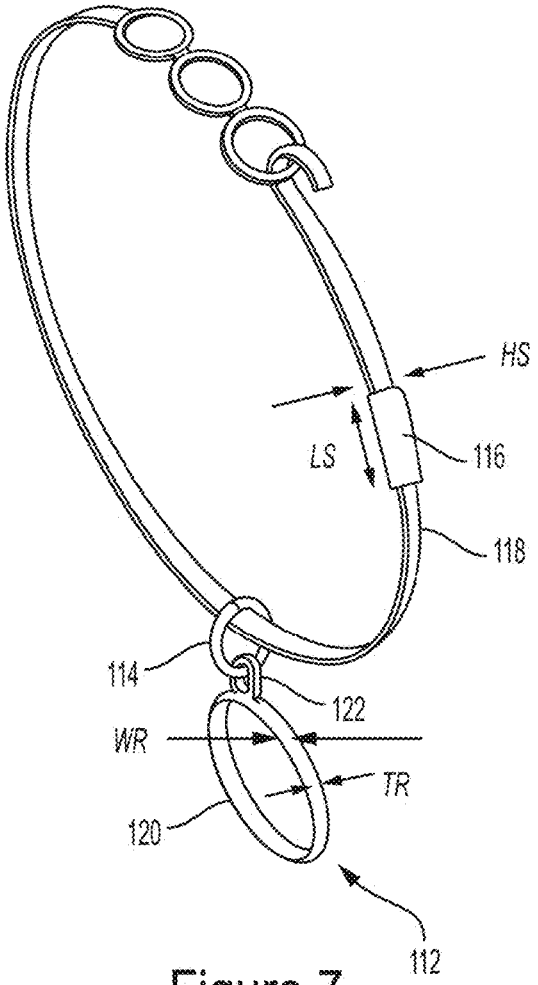
FIG. 7 is an adjustable bracelet according to one embodiment.

In some embodiments, the bracelet includes a charm or charms 112, as shown in FIG. 7. The charm 112 may be permanently attached to the bracelet in some embodiments. In other embodiments, the charm 112 includes a jump ring or loop 114 which is placed on the bracelet 100 and allows the charm 112 to be moveable along the bracelet 100.

Figure 8:
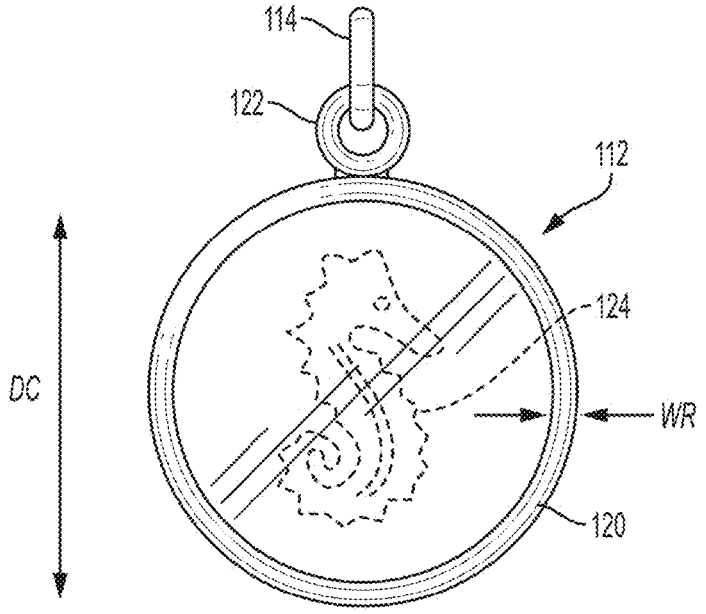
FIG. 8 is a charm of an adjustable bracelet according to one embodiment.

In some embodiments, as shown in FIG. 8, the charm 112 has a diameter DC, which, in some embodiments, is between about 16 mm and 24 mm. The diameter DC of the charm also may be about 20 mm±1 mm. In some embodiments, a circular bail 122 is attached to a rim 120 of the charm. As shown in FIG. 7, the loop 114 may extend through, or in some embodiments be threaded through, the bail 122. In some embodiments, the bail 122 has a thickness of between about 1.8 mm and 2.2 mm, and in some embodiments a thickness of about 2 mm±0.1 mm. The bail 122 may have a diameter of between about 3.6 and 4.4 mm, and in some embodiments, a diameter of about 4 mm±0.1 mm. In some embodiments, the loop 114 has an inner diameter of between about 6.5 and 7.5 mm, and in some embodiments of about 7 mm±0.1 mm. The loop 114 also has an outer diameter, which may be between about 7.5 mm and 9.5 mm. The loop 114 also has a thickness, which in some embodiments is between about 0.8 and 1.2 mm. The thickness of the loop also may be about 1 mm±0.1 mm.

In some embodiments, as shown in FIG. 7, the rim 120 of the charm 112 extends around a circumference of the charm 112. In some embodiments, the rim 120 extends around only a portion of the charm 112, while in other embodiments, the rim 120 extends around the entire circumference. The rim has a width WR, and in some embodiments, the width WR of the rim 120 is constant around the entire circumference of the charm 112 (see, e.g., FIG. 8). The width WR of the rim 120 also may vary around the circumference of the charm 112. The width WR of the rim 120 may be between about 1.0 mm and 1.4 mm. The width WR of the rim 120 also may be about 1.2 mm±0.1 mm. In some embodiments, the rim 120 of the charm is rounded, and in some embodiments slightly rounded, on its outer edge.

The rim 120 also may have a thickness TR, which in some embodiments is the same around the entire circumference of the charm 112. The thickness TR of the rim 120 also may vary around the circumference of the charm 112. The thickness TR of the rim 120 may be between about 1.8 mm and 2.2 mm. The thickness TR of the rim 120 also may be about 2 mm±0.1 mm. In some embodiment, the rim 120 of the charm 112 is cast in a lead-free pewter, which, in some embodiments has a sterling silver or 14K gold plating or a colored plating or paint. The rim 120 also may be formed of other suitable materials in other embodiments.

In some embodiments, as shown in FIG. 8, the charm 112 includes a decorative element 124. In one embodiment, as is shown, the decorative element 124 may be a seahorse, although other decorative elements 124 may be used. For example, the decorative element 124 may be a leaf, a nautilus shell, a star, a ladybug, a rearing horse, a whale tail, or another suitable shape. In some embodiments, the decorative element 124 appears to be floating within the rim 120 of the charm. In such an embodiment, the decorative element 124 may be surrounded by a liquid clear epoxy resin, which permanently hardens. In some embodiments, the decorative element 124 is a thin cut-out and photo-etched brass design. In some embodiments, the decorative element 124 is plated in imitation rhodium or 14K gold and then set inside rim 120. In some embodiments, the decorative element 124 is positioned in the center of the rim 120 of the charm. In other embodiments, a portion of the decorative element 124 may be positioned against a portion of an inner wall of the rim 120.

To prevent the charm 112 from sliding over the hook 108 and falling off of the bracelet 100 when the bracelet 100 is in an opened position, the bracelet may include a stopper 116. As shown in FIG. 7, the stopper may include a rectangular piece attached to an outer surface 118 of the bracelet 100. In some embodiments, the stopper 116 extends outwardly from the exterior surface 118 of the bracelet. The stopper may be placed along any portion of the outer surface 118 of the bracelet 100. In some embodiments, the stopper 116 is placed near the hook 108. In some embodiments, the stopper is placed between about 30 mm and 34 mm from the hook 108. The stopper also may be placed about 32 mm±1 mm from the hook 108. The distance between the hook and a proximal edge of the stopper (e.g., the edge of the stopper closest to the hook) also may be between about 22 mm and 26 mm, or between about 23 mm and 25 mm.

In some embodiments, the stopper 116 has a length LS between about 8 mm and 12 mm and in other embodiments the stopper has a length LS of about 10 mm±1 mm, although other suitable lengths may be used as this aspect of the disclosure is not limited in this regard. For example, in other embodiments, the stopper may have a length LS of between about 6 mm and about 8 mm or about 7 mm±0.5 mm. The stopper 116 also may have a height HS of between about 1 mm and 3 mm, although the stopper 116 may have a height that is smaller or taller in other embodiments. In some embodiments the stopper 116 includes a brass material that is soldered to the bracelet, although other materials may be used. As with the rest of the bracelet 100, the stopper 116 may be plated with gold, silver, or a colored plating or paint. The brand logo also may be stamped onto the surface of the stopper.

In some embodiments, the combined height HS of the stopper 116 and thickness TB of the bracelet 100 is larger than the inner diameter of the loop 114 such that the charm is enclosed within a portion of the bracelet 100. In other embodiments, the inner diameter of the loop 114 is larger than the combined height HS of the stopper 116 and thickness TB of the bracelet 100, such that the charm 112 may be slid onto the bracelet 100. In such an embodiment, the combined height HS of the stopper and thickness TB of the bracelet is configured such that the charm 112 will not easily slide over the stopper 116 when the bracelet 100 is in the opened position.

The stopper 116 may be attached to the bracelet 100 via soldering, epoxy, adhesives, or another suitable method. In some embodiments, depending upon the material of the bracelet, the stopper 116 may be formed integral with the bracelet 100 (i.e., the bracelet 100 and stopper 116 are molded, cast or braided together as one piece instead of separate parts). Although only one stopper 116 is shown in this figure, multiple stoppers 116 may be used to enclose the charm or charms 112 within a specific area on the bracelet 100. Also, while a rectangular shaped stopper 116 is shown, a skilled artisan should appreciate that the stopper may be any suitable shape. For example, the stopper 116 may be a ball, square, diamond, triangle, or any other organic or novelty shape such as a shell or duck.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. An adjustable bracelet, the bracelet comprising:

a first end having first, second and third size adjustment elements, each size adjustment element comprising a size adjustment opening having an inner concave surface; and a second end having a hook;

wherein the bracelet maintains a substantially circular shape when in an unlatched position;

wherein the second size adjustment element is adjacent the first and third size adjustment elements;

wherein each of the first, second and third size adjustment elements comprises an outer convex surface;

wherein the hook directly engages with a respective inner concave surface when the hook latches onto one of the first, second and third size adjustment elements;

wherein a diameter of the bracelet is adjusted when the hook is latched onto one of the first, second and third size adjustment elements.

2. The bracelet of claim 1, wherein each of the size adjustment elements has the same shape.

3. The bracelet of claim 1, wherein at least one of the size adjustment elements comprises a different shape than the other of the size adjustment elements.

4. The bracelet of claim 1, wherein each size adjustment opening has a diameter of between about 6 mm and 10 mm.

5. The bracelet of claim 1, wherein the hook extends inwardly and curves in a direction away from the size adjustment openings.

6. The bracelet of claim 1, wherein at least one of the first, second and third size adjustment elements is circular in shape.

7. The bracelet of claim 1, wherein each of the first, second and third size adjustment elements is circular in shape.

8. An adjustable bracelet, the bracelet comprising:

a first end having a clasp portion with first, second and third rings, the second ring being adjacent to the first and third rings;

a second end having a hook;

wherein the bracelet maintains a substantially circular shape when in an unlatched position;

wherein each of the first, second and third rings comprises an inner concave surface and an outer convex surface;

wherein the hook directly engages with a respective inner concave surface when the hook latches onto one of the first, second and third rings;

wherein a diameter of the bracelet is adjusted when the hook is latched onto one of the first, second and third rings.

9. The bracelet of claim 8, wherein each of the first, second and third rings has a diameter of between about 6 mm and 10 mm.

10. The bracelet of claim 8, wherein the hook extends inwardly and curves in a direction away from the first, second and third rings.

11. A method of adjusting a size of a substantially circular bracelet, the method comprising:

squeezing at least two points along a circumference of the bracelet to adjust a diameter of the bracelet, the bracelet comprising:

a first end having first, second, and third size adjustment elements, each size adjustment element comprising a size adjustment opening having an inner concave surface; and a second end having a hook;

wherein the second size adjustment element is adjacent the first and third size adjustment elements;

wherein each of the first, second, and third size adjustment elements comprises an outer convex surface;

inserting the hook into the size adjustment opening of one of the first, second, and third size adjustment elements; and releasing the at least two points along the circumference of the bracelet to cause the hook to directly engage a respective inner concave surface of the size adjustment opening.

* * * * *